US005146141A

United States Patent [19]

Rohde

[11] Patent Number: 5,146,141

[45] Date of Patent: Sep. 8, 1992

[54] HOLLOW-ELECTRODE SWITCH

[75] Inventor: Klaus-Dieter Rohde, Erlangen, Fed. Rep. of Germany

[73] Assignee: Siemens Aktiengesellschaft, Berlin & Munich, Fed. Rep. of Germany

[21] Appl. No.: 752,843

[22] Filed: Aug. 30, 1991

[30] Foreign Application Priority Data

Sep. 3, 1990 [EP] European Pat. Off. ..... 90116902

[51] Int. Cl.[5] ..... H01J 17/04; H01J 19/42

[52] U.S. Cl. ..... 315/326; 315/335; 313/590; 313/601; 313/603

[58] Field of Search ..... 315/326, 335, 233; 313/590, 601, 602, 603, 618, 619, 621, 632

[56] References Cited

U.S. PATENT DOCUMENTS

| | | | |
|---|---|---|---|
| 2,122,932 | 7/1938 | Duffendack et al. | 250/27.5 |
| 4,035,683 | 7/1977 | Hasson et al. | 313/601 X |
| 4,280,098 | 7/1981 | Veraldi | 328/59 |
| 4,320,321 | 3/1982 | Alexandrov et al. | 313/209 |
| 4,481,630 | 11/1984 | Box et al. | 313/601 X |
| 4,879,490 | 11/1989 | Weatherup | 313/601 |
| 4,939,416 | 7/1990 | Seeboeck et al. | 313/603 X |
| 5,038,082 | 8/1991 | Arita et al. | 315/326 |
| 5,055,748 | 10/1991 | Reinhardt | 313/590 X |
| 5,075,592 | 12/1991 | Seeboeck et al. | 313/603 X |

FOREIGN PATENT DOCUMENTS

| | | |
|---|---|---|
| 0337192 | 10/1989 | European Pat. Off. . |
| 3721529 | 1/1989 | Fed. Rep. of Germany . |
| 8910646 | 11/1989 | PCT Int'l Appl. . |

OTHER PUBLICATIONS

Journal of Physics E. Scientific Instruments, vol. 19, No. 6, Jun. 1986, Ishing, Bristol, GB, pp. 466–470: *High Repetition Rate, Fast Current Rise, Pseudo-Spark Switch.*

Proceedings of the VIIth International Conference on Phenomena in Ionized Gases, Beograd, vol. 1, 1965, pp. 316–326.

*Primary Examiner*—Eugene R. LaRoche
*Assistant Examiner*—Son Dinh
*Attorney, Agent, or Firm*—Kenyon & Kenyon

[57] ABSTRACT

A gas-discharge switch with a cold-cathode low-pressure gas discharge between the cathode and the anode has a discharge gap in a central discharge region of a discharge chamber. The maximum inside height of the discharge chamber determines the length of the discharge gap. In the discharge region, the inner surface of the discharge chamber is closed. Outside of the discharge region, the cathode is provided with at least one opening. This results in a gas-discharge switch with a short delay, low jitter and little voltage dependence with constant pressure.

38 Claims, 5 Drawing Sheets

HOLLOW-ELECTRODE SWITCH

BACKGROUND OF THE INVENTION

The present invention relates generally to hollow-electrode switches with opposing anodes and cathodes at a spacing a and forming discharge gaps. More specifically, the present invention relates to such a switch having a trigger device comprising a hollow electrode associated with the discharge gap that is disposed in an ionizable gas filling, wherein the pressure p of the gas and the electrode spacing d at the discharge gap are selected so that the breakdown voltage of the gas discharge drops with an increasing product of pressure p and electrode spacing d.

The breakdown voltage for a given gas-discharge gap and its usual graphic representation as a function of the product of gas pressure p and electrode spacing d in the breakdown curve is known to be an important aid for the characterization of electric-discharge devices, with due allowance being made for the probability of breakdown. In determining the dielectric strength of a given gas-discharge gap, an infinitely large plate capacitor and its breakdown characteristic are generally used for comparison purposes. However, the practical embodiment of such discharge gaps involves electrodes with finite dimensions. To determine the right branch of the breakdown curve (Paschen curve), the so-called far breakdown region, including the voltage minimum, it will suffice to arrange two plane, rounded plates, which optionally may be provided with a so-called Rogowski profile at the edges, parallel to each other. However, such an arrangement will be useless for the investigation of breakdown characteristics in the left portion of the Paschen curve, i.e., in the so-called near breakdown region, because shunted discharges may then occur. Such shunted discharges can be avoided by means of an electrode construction with plane plate electrodes which are arranged coaxially to each other, are bent away from each other at their edges with a radius of curvature that is small in relation to the electrode spacing, and are guided along the inner cylindrical insulator surface. Between the bent, cylindrical edge region of the electrodes and the inside wall of the hollow cylindrical insulator, a gap is thus always formed. With this embodiment of a low-pressure gas-discharge gap, the breakdown curve for various inert and molecular gases, for example, can be determined also in the near breakdown region, i.e. to the left of the minimum of the Paschen curve, as disclosed in the Proceedings of the Seventh International Conference on Phenomena in Ionized Gases, Beograd, vol. 1 (1965), pp. 316–326.

Gas-discharge switches are also known which are controlled through a pulsed low-pressure gas discharge. They will switch currents of 10 kA, for example, with a voltage of 20 kV. These discharge switches comprise an anode and a cathode which are provided with coaxial openings and are separated from each other at the edge by an annular insulator. For the gas discharge, a control device is provided that comprises a hollow electrode which is configured as a cage and is electrically connected to the cathode and thus is at cathode potential. It encloses the rear space of the cathode and separates it from a pre-ionization area. The gas discharge between cathode and anode is initiated by the injection of charge carriers. The discharge is started in two stages. First a pre-ionization is produced by an auxiliary electrode through a glow discharge outside of the hollow electrode. Then a negative pulse is applied to a trigger electrode and the penetration of charge carriers into the hollow electrode is made possible by switching the potential of a blocking electrode to zero. The discharge is initiated with the penetration of the charge carriers. This gas-discharge switch is relatively complicated. This is disclosed in J. Phys. E: Sci. Instr. 19 (1986), The Institute of Physics, Great Britain, pp. 466–470.

Another known design of a hollow-electrode switch in which the hollow electrode is electrically connected to the cathode comprises a cathode and an anode, each of which is provided with a central bore. A discharge gap is formed between these bores. The distance between the electrodes, which in the discharge region are arranged parallel to each other, is greater than in the channel formed between the electrodes outside of the discharge region in the radial direction. This is disclosed in German published patent application OS 37 21 529, FIG. 30.

The gas-discharge switch may also comprise a plurality of discharge channels which are provided with a trigger device that is common to all of them. This triggering device comprises a common hollow electrode which is electrically connected to the common cathode. The synchronous discharge in the discharge channels is initiated by charge carriers which penetrate from a pre-ionization region into the cathode rear space through holes in the bottom of the cage.

In this known design, the anode and the cathode are provided with a recess at each individual discharge gap, and the facing surfaces of anode and cathode therefore are not parallel to each other in the discharge region. The discharge gap is formed also in this arrangement between the central bores. This is shown in FIG. 13 of WO 89/10646.

The dielectric strength of the switch with constant gas pressure is essentially influenced by the electrode spacing, the diameter of the openings in the electrodes, the thickness of the electrode material, and hence the depth of the holes. The diameter of the openings has been found to be particularly critical since on the one hand high dielectric strength calls for a small diameter while on the other hand reliable triggering requires a predetermined minimum diameter. During the switching of high currents, the electrode material in the peripheral area of the openings is worn away with increasing switching cycles. This erosion will enlarge the diameter of the openings by about 50% over $10^7$ cycles. This reduces the dielectric strength and increases the feed-through into the cathode rear space, which can result in increasing disturbances of the triggering system through overvoltages.

The present invention is directed to the problem of simplifying and improving the known design of a hollow-electrode switch. In particular, the invention seeks to simplify the trigger device for the hollow-electrode switch, to substantially increase the product p times d, and to reduce the voltage dependence of delay and jitter.

SUMMARY OF THE INVENTION

The present invention solves this problem by placing the discharge gap in a central discharge region of a discharge chamber between the cathode and the anode, with the discharge chamber having its maximum inside height in the discharge region. This maximum inside height determines the length d of the discharge gap and decreases in the radial direction. In addition, the cathode has at least one opening outside of the discharge region.

In this design, the discharge gap is enclosed in a discharge chamber formed between the electrodes and connected with the hollow space of the hollow electrode through openings which are preferably arranged symmetrically with respect to the axis of rotation of the hollow-electrode switch. These openings are located outside of the discharge region with the maximum electrode spacing d, where the discharge takes place, and actually serve only for injection of the charge carriers from the hollow space of the control electrode into the discharge gap within the discharge chamber. The discharge thus always builds up between closed surface regions of cathode and anode.

In this design, the reference electrode has a dual function: it forms a cathode for the gas discharge on its side facing the discharge gap; and it forms a cathode for the glow discharge on its side facing the hollow electrode. With this hollow-electrode switch, a low voltage dependence is obtained at a given pressure. The openings are preferably inclined relative to the axis of rotation of the hollow-electrode switch. The angle of inclination is preferably at least 15 degrees, and more particularly at least 30 degrees.

A particularly high switching voltage and a very short delay are obtained when the ratio of the maximum electrode spacing d within the discharge chamber to the spacing a of the electrodes is at least 3:1, and preferably at least 5:1, and more particularly at least 10:1. In conjunction with openings in the cathode which are inclined with respect to the axis of rotation of the hollow-electrode switch, the ratio may be only 2:1 in some cases.

In a particularly advantageous design of the gas-discharge switch, in which the hollow electrode serves as the control electrode which is electrically insulated from the electrodes of the discharge gap, at least one space charge, and preferably a glow discharge, is produced in the hollow space of the control electrode. In this design of a gas-discharge switch with a cold-cathode low-pressure gas discharge, the control electrode combines the functions of the pre-ionization and trigger electrodes and a separate blocking electrode is no longer needed. A cold-cathode low-pressure gas-discharge switch with a high switching, short delay and little jitter is so obtained.

For the production of the space charge necessary for initiation of the discharge, a hot cathode, for example, located between the reference electrode and the bottom of the control electrode may be provided. Moreover, the space charge may also be produced by microwave excitation, for example, or by means of an optical trigger device, and more particularly a laser beam.

In a particularly advantageous design of the hollow-electrode switch, the space charge necessary for initiating the discharge is produced in the hollow space of the control electrode by means of a glow discharge. To this end, the control electrode may be simply connected directly to a trigger-voltage source for a negative trigger voltage with sufficient energy. The control electrode forms the anode and the reference electrode, located opposite the opening in the control electrode, forms the cathode for the glow discharge.

In another design, the hollow electrode may be connected to an additional voltage source with a positive potential for pre-ionization. This pre-ionization produces within the control electrode a low-current glow discharge that is not sufficient to initiate a discharge. Through this glow discharge, the dielectric strength at the discharge gap is increased, and with it the stability of the switch. Only then is the discharge initiated through a super-imposed negative trigger pulse of short duration and with a steep leading edge from the trigger electrode.

DETAILED DESCRIPTION

Figure 1:
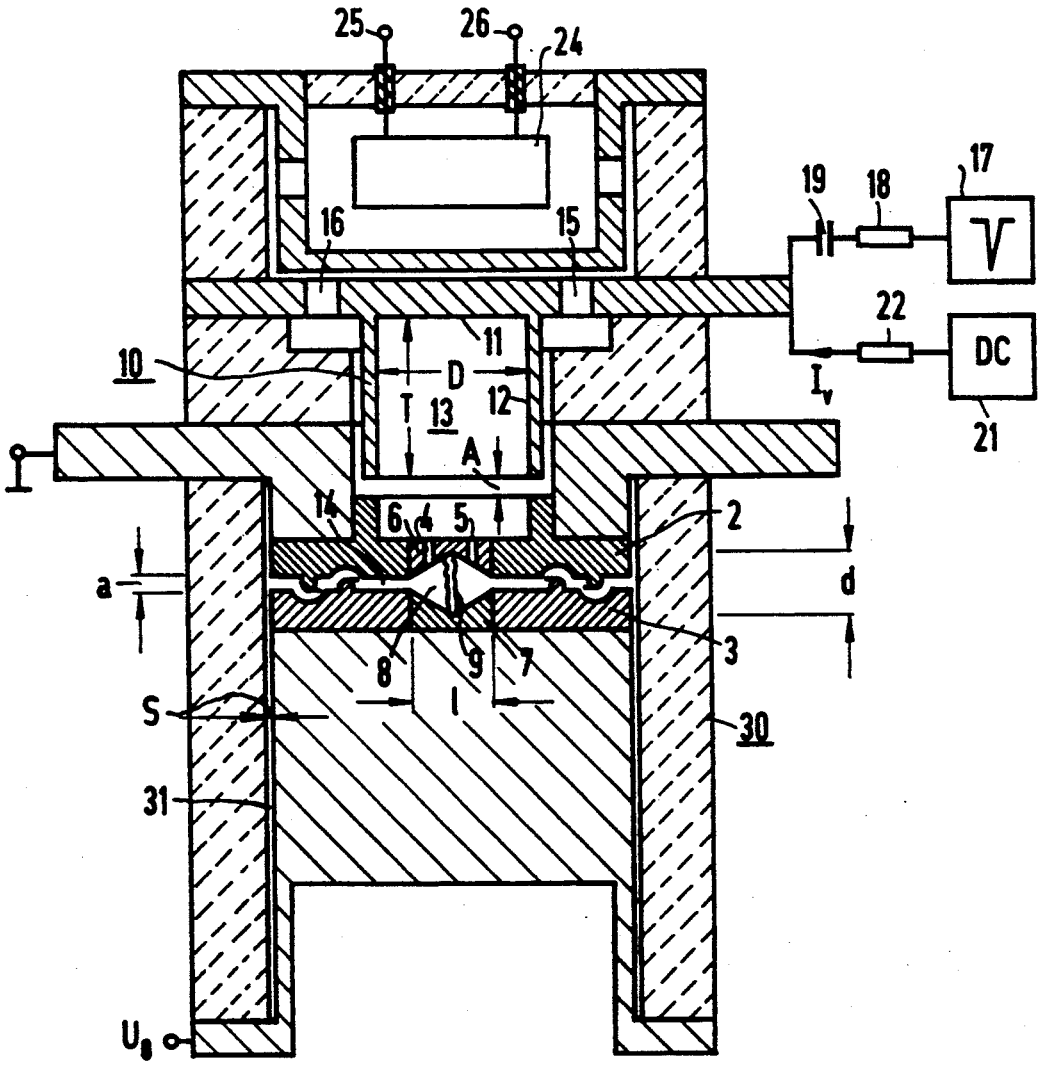
FIG. 1 diagrammatically illustrates an exemplary embodiment of a hollow-electrode switch in accordance with the present invention.

The Hollow-Electrode Switch of FIG. 1 Comprises a first electrode and a second electrode, one of which is connected as cathode 2 and the other as anode 3. The cathode 2 is provided with one or more openings, of which two, designated 4 and 5, are shown in FIG. 1. Through these two openings 4 and 5, a discharge is initiated in a gap 9 in a discharge chamber 8 formed in the central discharge region between the cathode 2 and the anode 3 by at least one recess in the electrodes. The surface of the cathode 2 which faces the anode 3 is configured so that a discharge chamber 8 having the shape of a double cone with facing base areas is formed. The cathode 2 and the anode 3, each of which generally forms a solid of revolution, are separated over their surface areas outside of the discharge chamber 8 by a spacing a which may range from 2 to 5 mm. The discharge in the gap 9 is initiated in the area of the maximum height d of the cathode 2 and the anode 3 within the discharge chamber 8. The discharge thus builds up between closed surface areas of the cathode 2 and the anode 3, and erosion of the openings 4 and 5, located outside of this central space, is thus virtually precluded. The maximum electrode spacing d within the discharge chamber 8 is at least 3 mm, and preferably at least 6 mm, and more particularly substantially greater than 10 mm. The cathode 2 and the anode 3 consist of an electrically conductive material, and preferably of high-grade steel, and may generally be provided in the area of the discharge chamber 8 with special insets 6 and 7 of a high-melting metal, for example, an alloy containing tungsten, W, or molybdenum, Mo, or consist entirely of such a high-melting metal.

In a particularly advantageous design, the trigger device for the discharge gap 9 comprises a control electrode 10 in the form of a hollow electrode whose bottom 11 and side wall 12 enclose a hollow space 13. The opening of the hollow space 13 faces the discharge gap 9, and is preferably electrically insulated from its reference electrode. The distance A of the opening from the potential of its reference electrode, that is in this design with positive switching voltage $U_o$ of for example 40 kV the cathode 2, is less than the length of the cathodic dark space of the flow discharge of the working gas. The control electrode 10 consists of an electrically conductive material, for example, high-grade steel, and has at least the shape of a dish, and preferably of a pot, whose depth T is substantially greater than its diameter D. The shape of the pot of the control electrode 10 is preferably such that the ratio of the depth T to the diameter D is about 1:1 to 5:1, and more particularly about 2:1.

The hollow space 13 and the discharge chamber 8 contain a gas filling or an ionizable working gas, preferably hydrogen or deuterium or a mixture of these gases. Nitrogen, too, is known to be suitable, as is an inert gas such argon or helium. An accumulator 24 for the working gas, represented merely diagrammatically in the figure, is provided with a heating means, not shown in the figure, whose electrical connections, designated 25 and 26, are fed through he wall of the switch. The space surrounding the gas accumulator 24 communicates with the hollow space 13 through pressure-equalization openings 15 and 16 in the electrical connection for the control electrode 10.

In a special design of the hollow-electrode switch, the gas reservoir of the accumulator 24 preferably serves also as a pressure-regulating system for the hollow-electrode switch.

Associated with the control electrode 10 is a trigger-voltage source 17, which may be connected to the control electrode 10 through a limiting resistor 18 and a decoupling capacitor 19. The trigger-voltage source 17 delivers a trigger pulse with a steep leading edge and a negative voltage of about 0.5 to 10 kV, for example, and preferably about 1 to 5 kV relative to the reference potential of the cathode 2, which may be ground potential, for example, and from which the control electrode 10 is electrically insulated. The duration of the trigger pulse is at least as great as the delay of the discharge gap 9 and may range from about 0.1 to 2 μs, for example, and preferably from about 0.5 to 1 μs.

In a special design of the hollow-electrode switch of the invention, there may be associated with the control electrode 10 an additional voltage source 21 for pre-ionization, whose positive voltage relative to the reference potential of the cathode 2 may range from about 0.1 to 5 kV, for example, and which may be connected to the control electrode 10 through a high-value series resistor 22 of preferably several megohms. This positive voltage of the voltage source 21 is selected so that it will produce within the control electrode 10 a low-current glow discharge in the range from a few micro-amperes to a few milliamperes, for example, that is not sufficient to result in a breakdown at the discharge gap 9. This breakdown is initiated only with the trigger pulse from the trigger-voltage source 17. An insulator 30 in the form of a hollow cylinder made of glass or of a ceramic, for example, and whose interior wall is separated from the cathode 2 and the anode 3 by a hollow-cylindrical slot 31 of a width S that is smaller than the spacing a between the cathode 2 and the anode 3 in the channel 14 outside the discharge chamber 8, serves for electrical insulation between the cathode 2 and the anode 3 and as side wall of the switch housing. The width S of the slot 31 is preferably not greater than one-half the spacing a. The resulting design of the hollow-electrode switch with a switching voltage $U_o$ of 30 kV, for example, has an electrode spacing a of 3.5 mm. in channel 14, and a maximum electrode spacing d of 10.5 mm at the discharge gap 9 within the discharge chamber 8, and with hydrogen as the working gas, whose pressure p should be 28.5 Pa, for example, and a product p times d of 300 Pa-mm.

Regardless of the polarity of the switching voltage $U_o$, the reference electrode referred to as cathode 2 forms the reference potential for the trigger-voltage source 17 and the voltage source 21.

The openings 4 and 5 in the cathode 2 are represented as bores. However, these openings might also be configured as slots or elongated holes, in straight or annular form.

FIG. 1 shows a discharge chamber 8 in the form of a double cone. However, the discharge chamber 8 might also be formed through a recess of another shape, for example, a dish, a sphere or a cylinder, or a combination of these shapes.

Figure 2:
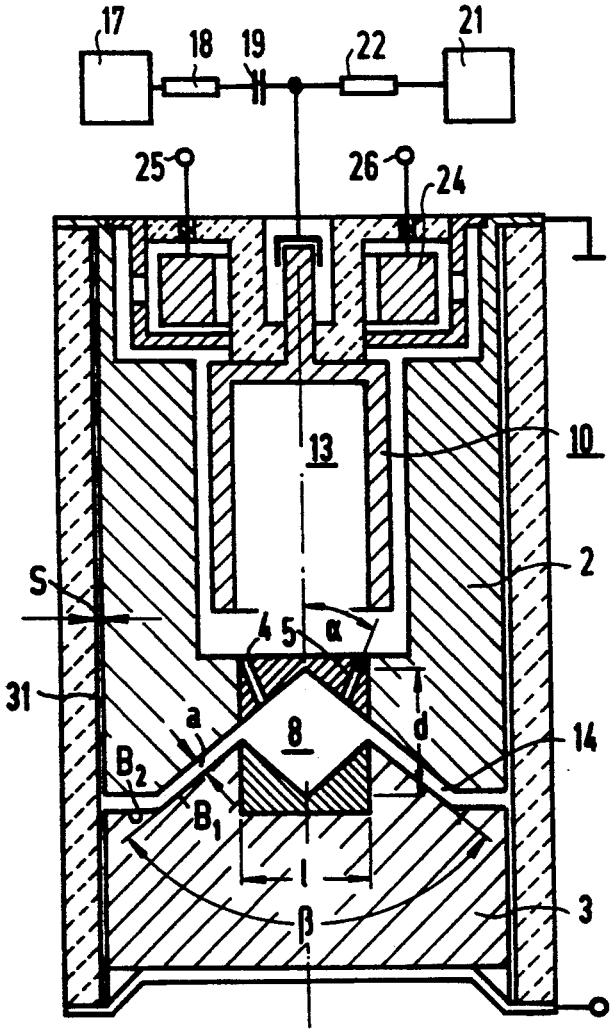
FIG. 2 shows an embodiment of the hollow-electrode switch with a specially configured channel between the electrodes of the discharge gap.

In the design of a hollow-electrode switch shown in FIG. 2, a cathode 2 and an anode 3 are configured so that their facing surfaces form, over a surface area $B_1$ outside the discharge chamber 8, parts of a hollow cone having the same generating angle $\beta$. In an outer surface area $B_2$ in proximity to the slot 31, an annular channel is formed by washer-like surface portions of the electrodes. The discharge chamber 8 communicates with the hollow space 13 of the control electrode 10 through openings 4 and 5, which are preferablY inclined relative to the axis of rotation of the hollow-electrode switch. Through the inclination of the openings 4 and 5, whose angle of inclination $\alpha$ is preferably at least 15°, the hollow space 13 of the control electrode 10 is decoupled from the discharge gap 9 in the discharge chamber 8. The discharge chamber 8 is bounded by the hollow-conical notch in the cathode 2 and a likewise hollow-conical notch in the anode 3. In conjunction with a maximum spacing d within the discharge chamber 8 of at least 20 mm, the product p times d may exceed 600 Pa mm.

In the design of FIG. 2, an annular gas accumulator 24 is provided in whose annular opening the electrical connection, not shown in detail, for the control electrode 10 is indicated and the connection to the control-voltage sources 17 and 21 is made.

Figure 3:
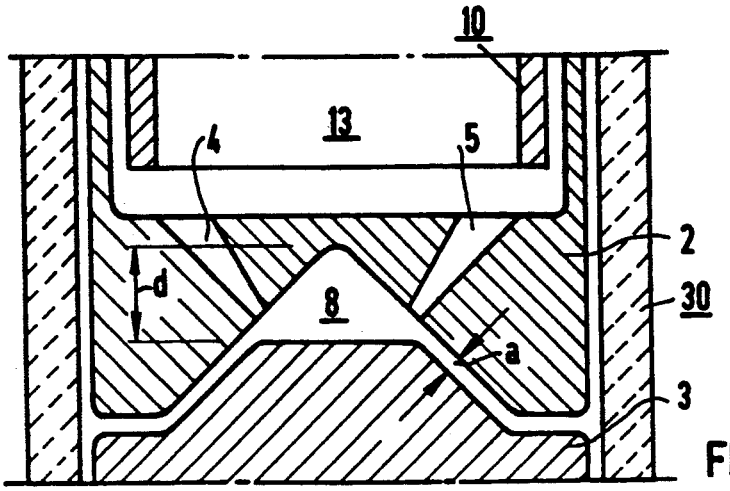
FIGS. 3 to 7 are individual embodiments of the discharge chamber.

In FIG. 3, only the cathode 2 with its openings 4 and 5, the anode 3, a portion of the control electrode 10, and the insulator 30 are illustrated. In this design, a hollow-conical discharge chamber 8, formed by a corresponding notch in the cathode 2, is provided. The discharge chamber 8 communicates through conical openings 4 and 5 with the hollow space 13 of the control electrode 10. The injection of charge carriers into the discharge gap in the discharge chamber 8 is facilitated through this shape of the openings 4 and 5. The facing surfaces of the cathode 2 and the anode 3 outside the discharge chamber 8 form the generated surfaces of a truncated cone having the same generating angle and are spaced apart by the distance a over that surface area. In this design of the conical discharge chamber 8, a discharge gap is obtained with the electrode spacing d between the base area of the hollow cone of the control electrode 10 on the surface of the anode 3 and the preferably rounded vertex of the cone in the cathode 2.

Figure 4:
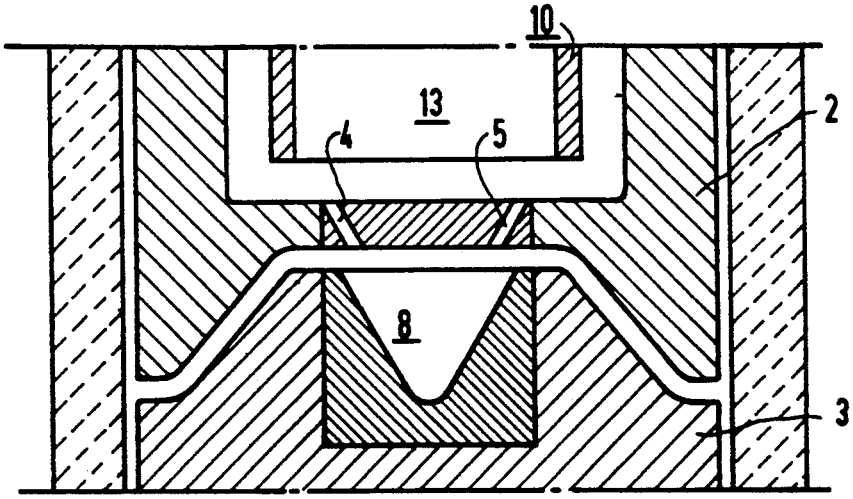

However, as shown in FIG. 4, a discharge chamber 8 in the form of a hollow cone may also be formed through a corresponding recess in the anode 3. In this design, an approximately disk-like cathode 2 with correspondingly short openings 4 and 5 between the discharge chamber 8 and the hollow space 13 of the control electrode 10 is obtained in the area of the discharge chamber 8.

Figure 5:
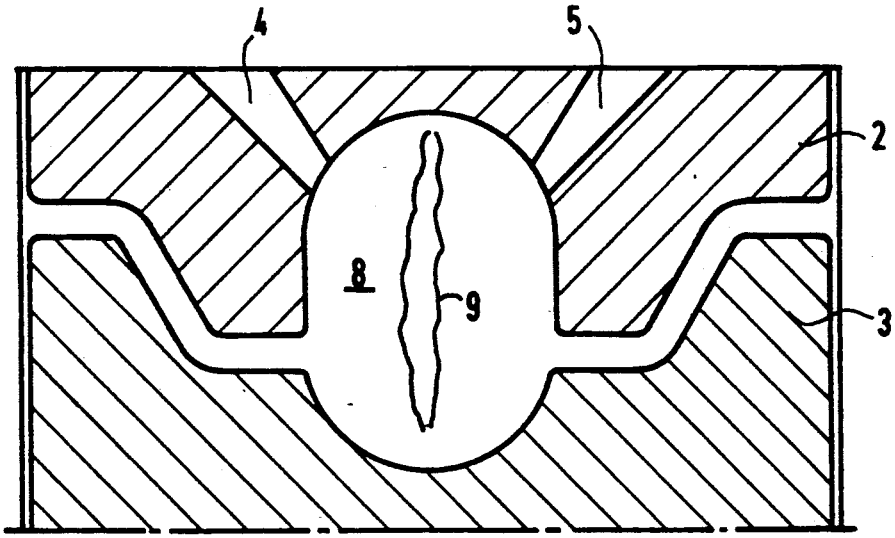

In the design of the discharge chamber 8 shown in FIG. 5, both the cathode 2 and the anode 3 are provided with a recess in the area of the discharge chamber 8. The recess in the anode 3 is in the form of a spherical cup, and the recess in the cathode 2 starts out as a cylinder and ends in a spherical cup, for example. In this design of the discharge chamber 8, the discharge gap 9 communicates through conical openings 4 and 5 with the hollow space 13 (not shown) of the control electrode 10.

Figure 6:
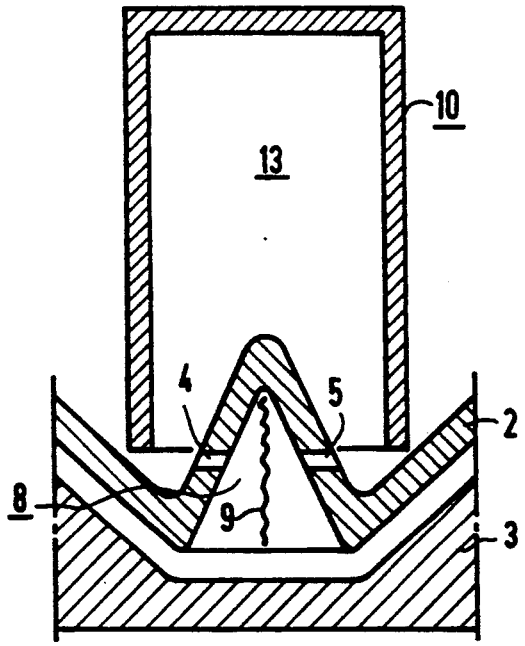

In the design of the hollow-electrode switch shown in FIG. 6, the cathode 2 is a shaped body of approximately constant thickness which forms the circumference of a discharge chamber 8 in the form of a hollow cone whose vertex projects into the hollow space 13 of the control electrode 10. A corresponding recess in the anode 3 in the area of the discharge chamber 8 is substantially plane and forms the base area of the hollow cone forming the discharge chamber 8. In this design, the inclination of the openings relative to the central axis (not shown specifically) may be approximately 90°. This results in the appropriate decoupling of the discharge gap 9 from the hollow space 13 of the control electrode 10.

Figure 7:
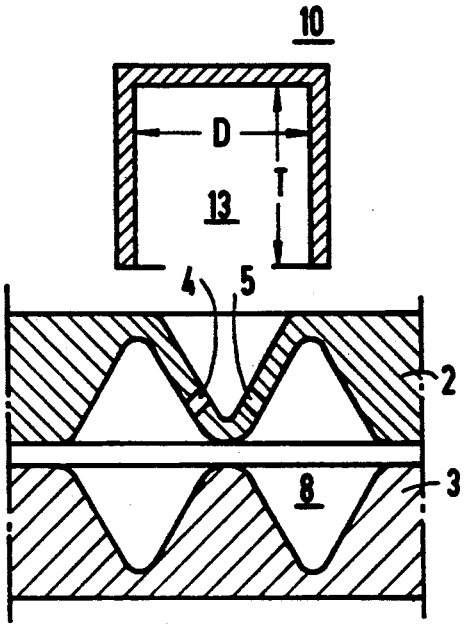

In the design of a hollow-electrode switch shown in FIG. 7, an annular discharge chamber 8 is formed between the cathode 2 and the anode 3 through annular conical recesses. The cathode 2 comprises in the area of the discharge chamber 8 a shaped body of substantially constant thickness and a depression in its surface portion facing the hollow space 13 of the control electrode 10. That depression in effect enlarges the hollow space 13 so that with this design a control electrode 10 whose depth T is not substantially greater than its diameter D will still be adequate. The openings 4 and 5 are located in the area of constant thickness of the cathode 2.

Figure 8:
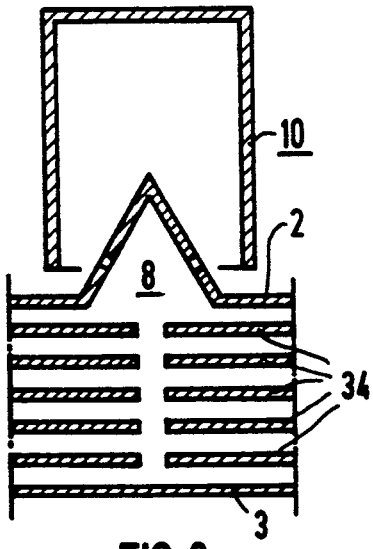
FIG. 8 illustrates an embodiment of the hollow-electrode switch for a particularly high switching voltage with a plurality of electrodes.

In the embodiment illustrated in FIGS. 1 and 2, a hollow-electrode switch is shown that comprises only one cathode 2 and one anode 3. However, a multi-electrode arrangement with intermediate electrodes 34, each with a central opening, as shown diagrammatically in FIG. 8, might also be provided. With this design, a reduced field strength is obtained between the electrodes, forming a hollow-electrode switch for a particularly high switching voltage.

Figure 9:
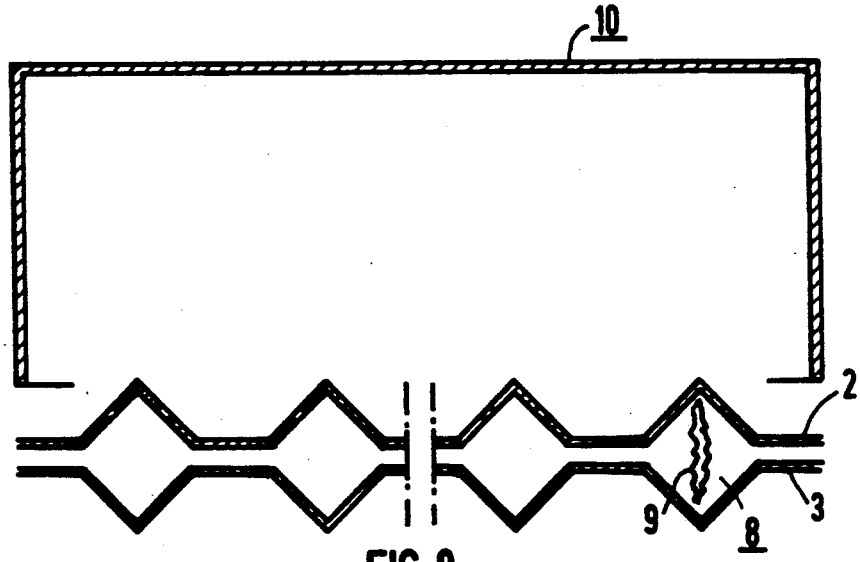
FIG. 9 shows an embodiment for high currents with a plurality of discharge gaps.

In another design, shown in FIG. 9, the hollow-electrode switch may comprise a plurality of discharge chambers 8, each with an individual discharge gap 9, which are electrically connected in parallel and provided with a common control electrode that is electrically insulated from its reference electrode 2. This common control electrode 10 is provided with means, not shown in the figure, for producing a space charge, and more particularly a glow discharge. A faster rate of current rise and a reduced switch inductance and switch resistance are thus obtained. Additionally, this design has a high current-carrying capacity as well as a long service life. The individual discharge chambers 8 may be arranged side by side in line or also axially symmetrical with respect to a central axis of the hollow-electrode switch.

Figure 10:
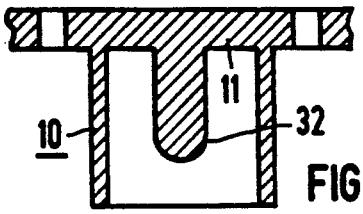
FIGS. 10 and 11 depict special embodiments of the control electrode.

In the design of a control electrode 10 shown in FIG. 10, the bottom 11 of the control electrode 10 is provided with an extension 32 whose free end is directed toward the discharge gap 9. The extension 32 is in the form of a cylinder whose end has a rounded edge. This extension 32 serves to influence the glow discharge, and particularly the distribution of the space-charge density, within the control electrode 10.

Figure 11:
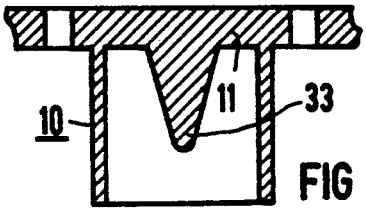

In FIG. 11, the extension 32 is in the form of a cone whose rounded vertex is directed toward the discharge gap 9.

What is claimed is:

1. A hollow-electrode switch comprising:

a) first electrode coupled to a high voltage source;

b) a second electrode coupled to a high voltage source, disposed opposite said first electrode at a predetermined space (a) from said first electrode outside of a central discharge region, and having an opening disposed outside of the central discharge region;

c) the second electrode is a reference electrode for a glow discharge;

d) a trigger device comprising a control electrode in the form of a hollow electrode, which is an anode for said glow discharge and is disposed so that its opening is turned toward the reference electrode and its lower edge is disposid at a distance (A) from said reference electrode and it is electrically connected to a trigger-voltage source;

e) a discharge chamber formed between said first and second electrode in the discharge region, having a discharge gap of a predetermined distance (d) disposed in a central discharge region between the anode and cathode for a low-pressure gas discharge, having a maximum inside height determining the predetermined distance (d) and decreasing in a radial direction in the discharge region;

f) an ionizable gas filling a volume inside the discharge chamber, having a discharge path and having a predetermined pressure (p) such that a breakdown voltage of the low-pressure gas discharge decreases when a product (pd) of predetermined pressure (p) and predetermined distance (d) increases.

2. The hollow-electrode switch according to claim 1, wherein the discharge chamber further comprises an inner surface in the discharge region which is concave.

3. The hollow-electrode switch according to claim 1, wherein the predetermined pressure (p) and the predetermined distance (d) are such that the product (pd) is greater then or equal to 150 Pa-mm.

4. The hollow-electrode switch according to claim 1, wherein the predetermined pressure (p) and the predetermined distance (d) are such that the product (pd) is greater than or equal to 300 Pa-mm.

5. The hollow-electrode switch according to claim 1, wherein said opening in the second electrode is inclined by an angle $\alpha$ relative to an axis of rotation of the hollow-electrode switch.

6. The hollow-electrode switch according to claim 5, wherein the angle $\alpha$ is greater than or equal to 15°.

7. The hollow-electrode switch according to claim 5, wherein the angle $\alpha$ is greater than or equal to 30°.

8. The hollow-electrode switch according to claim 5, wherein the maximum inside height of the discharge chamber is such that a ratio of the maximum inside height to the predetermined spacing (a) is greater than or equal to 2.

9. The hollow-electrode switch according to claim 1, wherein the maximum inside height of the discharge chamber is such that a ratio of the maximum inside height to the predetermined spacing a is greater than or equal to 3.

10. The hollow-electrode switch according to claim 1, wherein the maximum inside height of the discharge chamber is such that a ratio of the maximum inside height to the predetermined spacing a is greater than or equal to 5.

11. The hollow-electrode switch according to claim 1, wherein the maximum inside height of the discharge chamber is such that a ratio of the maximum inside height to the predetermined spacing a is greater than or equal to 10.

12. The hollow-electrode switch according to claim 1, wherein the first electrode further comprises a facing surface and the second electrode further comprises a facing surface, which facing surfaces form generated surfaces of a truncated cone with the same generating angle $\beta$ in a first region outside the discharge chamber, and annular surfaces opposed to each other at a spacing a in a second region outside the discharge chamber.

13. The hollow-electrode switch according to claim 1, wherein the discharge chamber further comprises a shape with a conical cross section.

14. The hollow-electrode switch according to claim 1, wherein the discharge chamber further comprises a shape with a cross section that looks substantially like two cones with facing bases.

15. The hollow-electrode switch according to claim 1, wherein the discharge chamber comprises a form substantially like a spherical cup.

16. The hollow-electrode switch according to claim 1, wherein the discharge chamber comprises a form substantially like two spherical cups with facing bases.

17. The hollow-electrode switch according to claim 1, wherein the discharge chamber comprises a form substantially like a cylinder with spherical ends.

18. The hollow-electrode switch according to claim 1, wherein the trigger device further comprises a hollow space, and said opening has a diameter which increases toward the hollow space.

19. The hollow-electrode switch according to claim 1, wherein said opening is shaped like a slit.

20. The hollow-electrode switch according to claim 1, wherein the trigger device further comprises means for producing a space charge disposed in the hollow electrode, wherein the hollow electrode is a control electrode for the low-pressure gas discharge.

21. The hollow-electrode switch according to claim 20, wherein the control electrode is an anode for a glow discharge in the hollow space.

22. The hollow-electrode switch according to claim 21, wherein the control electrode is electrically coupled to the high voltage source, which emits a negative control pulse.

23. The hollow-electrode switch according to claim 22, further comprising a decoupling resistor and a decoupling capacitor coupled in series and disposed between the control electrode and the high voltage source.

24. The hollow-electrode switch according to claim 22, further comprising a an accumulator coupled to the control electrode.

25. The hollow-electrode switch according to claim 21, further comprising a means for producing pre-ionization within the control electrode coupled to the control electrode.

26. The hollow-electrode switch according to claim 25, further comprising a positive direct-current (dc) voltage source, and a decoupling resistor coupled between the control electrode and the positive dc voltage source.

27. The hollow-electrode switch according to claim 15, wherein the hollow electrode is a control electrode which has a shape substantially like a pot.

28. The hollow-electrode switch according to claim 27, wherein a ratio of a depth (T) of the pot to a diameter (D) of the control electrode ranges from 1:1 to 5:1.

29. The hollow-electrode switch according to claim 27, wherein a ratio of a depth (T) of the pot to a diameter (D) of the control electrode is approximately 2:1.

30. The hollow-electrode switch according to claim 20, wherein the discharge chamber further comprises a shape substantially like a cone, the control electrode further comprises an opening, and the cathode has an approximately constant thickness in an area of the discharge chamber and projects into the opening in the control electrode.

31. The hollow-electrode switch according to claim 20, wherein the discharge chamber further comprises a shape substantially like two cones with facing bases, the control electrode further comprises an opening, and the cathode has an approximately constant thickness in an area of the discharge chamber and projects into the opening in the control electrode.

32. The hollow-electrode swith according to claim 20, wherein the discharge chamber further comprises a shape substantially like a hollow ring, the second electrode further comprises a cover with an approximately constant thickness in an area of the discharge chamber for the discharge chamber, and a depression formed in a central area of the cover which increases the depth T of the hollow space of the hollow space of the control electrode.

33. The hollow-electrode switch according to claim 1, further comprising a plurality of intermediate electrodes and a common discharge channel into the control electrode.

34. The hollow-electrode switch according to claim 1, further comprising a reference electrode, a plurality of individual discharge gaps which are electrically coupled in parallel and a common control electrode that is disposed at a distance (A) from the reference electrode.

35. The hollow-electrode switch according to claim 20, wherein the control electrode further comprises a bottom with an extension.

36. The hollow-electrode swith according to claim 35, wherein the extension has a cylindrical form and an end directed toward the discharge chamber is rounded.

37. The hollow-electrode swith as defined in claim 35, wherein the extension has a conical form and an end directed towards the discharge chamber which is rounded.

38. The hollow-electrode switch as defined in claim 1 comprising a hollow electrode that is electrically insulated form the reference electrode.

* * * * *